US011286080B1

(12) United States Patent
Graham

(10) Patent No.: US 11,286,080 B1
(45) Date of Patent: Mar. 29, 2022

(54) PRODUCT DISPLAY WITH FLIP-UP HEADER

(71) Applicant: WESTROCK CONTAINER, LLC, Atlanta, GA (US)

(72) Inventor: Mark'el Graham, Acworth, GA (US)

(73) Assignee: WESTROCK CONTAINER, LLC, Atlanta, GA (US)

( * ) Notice: Subject to any disclaimer, the term of this patent is extended or adjusted under 35 U.S.C. 154(b) by 193 days.

(21) Appl. No.: 16/589,870

(22) Filed: Oct. 1, 2019

Related U.S. Application Data

(60) Provisional application No. 62/740,043, filed on Oct. 2, 2018.

(51) Int. Cl.
*B65D 5/42* (2006.01)

(52) U.S. Cl.
CPC ..... *B65D 5/4225* (2013.01); *B65D 5/4266* (2013.01)

(58) Field of Classification Search
CPC ... B65D 5/4225; B65D 5/4266; B65D 5/4212
USPC ..... 206/767, 768, 736
See application file for complete search history.

(56) References Cited

U.S. PATENT DOCUMENTS

| | | | | |
|---|---|---|---|---|
| 6,038,797 | A * | 3/2000 | Smith | G09F 15/0056 206/768 |
| 6,109,514 | A * | 8/2000 | Otis | B65D 5/4225 206/459.5 |
| 6,386,371 | B1 * | 5/2002 | Parsons | B65D 5/504 206/485 |
| 7,337,909 | B1 * | 3/2008 | Morgan | B65D 5/001 206/736 |
| 9,186,453 | B1 | 11/2015 | Russell | |
| 2017/0238727 | A1 * | 8/2017 | Ertl | G09F 15/0062 |
| 2019/0008290 | A1 | 1/2019 | Ertl | |
| 2019/0185200 | A1 | 6/2019 | Ertl | |

* cited by examiner

*Primary Examiner* — Steven A. Reynolds
(74) *Attorney, Agent, or Firm* — Neil G. Cohen

(57) ABSTRACT

A product display can include a product support structure, and a flip-up display header movably and integrally coupled to the product support structure. The display header is automatically movable with respect to the product support structure from a retracted shipping position to an extended display position.

10 Claims, 3 Drawing Sheets

PRODUCT DISPLAY WITH FLIP-UP HEADER

CROSS-REFERENCE TO RELATED APPLICATIONS

This application claims priority to and the benefit of U.S. Provisional Application No. 62/740,043, filed Oct. 2, 2018, the entire contents of which are herein incorporated by reference in their entirety.

FIELD

This disclosure relates to a product display, and particularly to a product display having a tray and display header.

BACKGROUND

Packaging for articles having indicia may not perform as desired for both shipping and display, for example. Conventional methods and systems have generally been considered satisfactory for their intended purpose. However, there is still a need in the art for improved product display packaging. The present disclosure provides a solution for this need.

SUMMARY

In accordance with at least one aspect of this disclosure, a product display can include a product support structure, and a flip-up display header movably and integrally coupled to the product support structure. The display header is automatically movable with respect to the product support structure from a retracted shipping position to an extended display position.

In certain embodiments, the product support structure can be a tray. The tray can be configured to support one or more products in a product-storage region for display in a retail location.

The display header can include a product indicia display area on a front side of display header for displaying product indicia related products stored in tray when display header is located in the extended display position. The product display can be sized to fit on a shelf or a counter-top.

The tray can include a front wall, a back wall spaced apart from and parallel to front wall, a left side wall, a right side wall spaced apart from and parallel to left side wall, and a floor that extends between bottom ends of each wall, wherein the walls and floor define product-storage region.

The display header can include a header board and a stem rigidly coupled to a bottom end of header board. The bottom end of the header board and a top end of the stem can be movably coupled to a top end of a back wall of tray. The bottom end of header board can be integrally coupled to the top end of back wall of tray along a fold line that forms a pivotable hinge having a pivot axis that extends along the fold line such that the header board and the stem of the display header are movably coupled to the top end of back wall of tray for conjoint pivotal movement about the pivot axis.

The product display can include an actuator resiliently and movably coupling the stem of display header to a bottom end of back wall of the tray. The actuator can be an elastic member, for example. In certain embodiments, the elastic member can include an elastic cord having barbs attached to opposing ends thereof for securing the elastic member to the tray. The biasing force applied to the stem of the display header by the elastic member can automatically conjointly pivot the header board and the stem of the display header about the pivot axis to the upright extended display position. When display header is in the retracted shipping position, the elastic member can resiliently bias the header board and the stem of the display header to pivot about the fold line and the pivot axis from the retracted shipping position to the upright extended display position. When the header board and the stem of the display header are in the extended display position, the header board and the stem can be vertical and coplanar with the back wall of tray, and the stem of the display header can extend downwardly below the fold line. Also, the pivot axis and can be located adjacent to an outer surface of the back wall of the tray. When the header board and the stem of the display header are in the retracted shipping position, the header board and the stem can be horizontal and parallel to the floor of the tray and the stem can project horizontally outwardly from the fold line and the pivot axis and from the back wall of the tray, while the header board can project outwardly in the opposite direction from the fold line and pivot axis and from the back wall of the tray.

The product display can include an external casing configured to restrain the display header from pivotal movement from the retracted shipping position to the extended display position. When the external casing is removed from the product display, the header board and the stem of the display header can automatically self-deploy and flip up from the retracted shipping position to the extended display position.

In accordance with at least one aspect of this disclosure, a blank can be configured to form any suitable product display as disclosed herein, e.g., as described above. For example, a blank can include a tray blank portion for forming the product support structure. The tray blank portion can include a rectangular floor panel, a left side wall panel coupled to the floor panel along a first fold line, and a left flap coupled to the left side wall panel along a second fold line. The left flap can include an outer free edge having spaced apart outwardly extending left locking tabs. The tray blank portion can include a left front flap coupled to a front edge of the left side wall panel along a third fold line that is perpendicular to the first fold line, and a right side wall panel coupled to the floor panel along a fourth fold line. The fourth fold line can be parallel to the first fold line.

The tray blank portion can include a right flap coupled to the right side wall panel along a fifth fold line. The right flap can include an outer free edge having spaced apart outwardly extending right locking tabs, a right front flap coupled to a front edge of the right side wall panel along a sixth fold line that is perpendicular to the fourth fold line and is colinear with the third fold line, and a rectangular front wall panel coupled to a front end of the floor panel along a seventh fold line that is parallel to and colinear with the third fold line and the sixth fold line. The tray blank portion can include a rectangular front flap coupled to an outer end of the front wall panel by an eighth fold line that is spaced apart from and parallel to the seventh fold line. The front flap can include an outer free edge having spaced apart outwardly extending front locking tabs.

The tray blank portion can include a plurality of left spaced apart elongate slots extending along and adjacent to the first fold line and configured to receive the left locking tabs. The tray blank portion can include a plurality of right spaced apart elongate slots extending along and adjacent to the fourth fold line and configured to receive the right locking tabs. The tray blank portion can include a plurality of front spaced apart elongate slots that extend along and adjacent to the seventh fold line and configured to receive the front locking tabs.

The tray blank portion can include a rectangular rear wall panel coupled at a bottom end thereof to a rear end of the floor panel along a ninth fold line that is perpendicular to the first fold line and the fourth fold line and parallel to the seventh fold line. The rear wall panel can include a plurality of spaced apart apertures located adjacent the ninth fold line at the bottom end of the rear wall panel. Each aperture can include a notch adapted to receive and retain a respective end of one or more elastic members.

The tray blank portion can include a left rear flap coupled to a left edge of the rear wall panel along a tenth fold line that is perpendicular to the ninth fold line and parallel to the first fold line, and a right rear flap coupled to a right edge of the rear panel along an eleventh fold line that is perpendicular to the ninth fold line and is spaced apart from and parallel to the tenth fold line.

The blank can include a display header portion for forming the flip-up display header. The display header portion can include a rectangular back header panel having a bottom edge that is integrally coupled to the top edge of the rear wall panel along a twelfth fold line that is parallel the ninth fold line. The display header portion can include a rectangular front header panel coupled to a top end of the back header panel along a thirteenth fold line that is parallel to and spaced apart from the twelfth fold line. The front header panel can include a linear free edge that is spaced apart from and parallel to the thirteenth fold line;

The display header portion can include a left connector panel including a left top panel having a bottom end connected to a top end of a left bottom panel along a fourteenth fold line. A top end of the left top panel can include a left top aperture and a bottom end of the left bottom panel including a left bottom aperture. The display header portion can include a right connector panel including a right top panel having a bottom end coupled to a top end of a right bottom panel along a fifteenth fold line. A top end of the right top panel can include a right top aperture and a bottom end of the right bottom panel can include a right bottom aperture. The apertures can be configured to receive the one or more elastic members.

In certain embodiments, the second fold line is disposed at an acute angle to the first fold line, and the fifth fold lines can be disposed at an acute angle to the fourth fold line. In certain embodiments the second and fifth fold lines can be double fold lines. Any line disclosed herein, can be any suitable line type (e.g., single fold line, double fold line, perforated, cut, etc.) and/or separate from or attached to any other suitable portion in any suitable manner.

The blank can be made of corrugated board or plastic board. Any other suitable material is contemplated herein.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
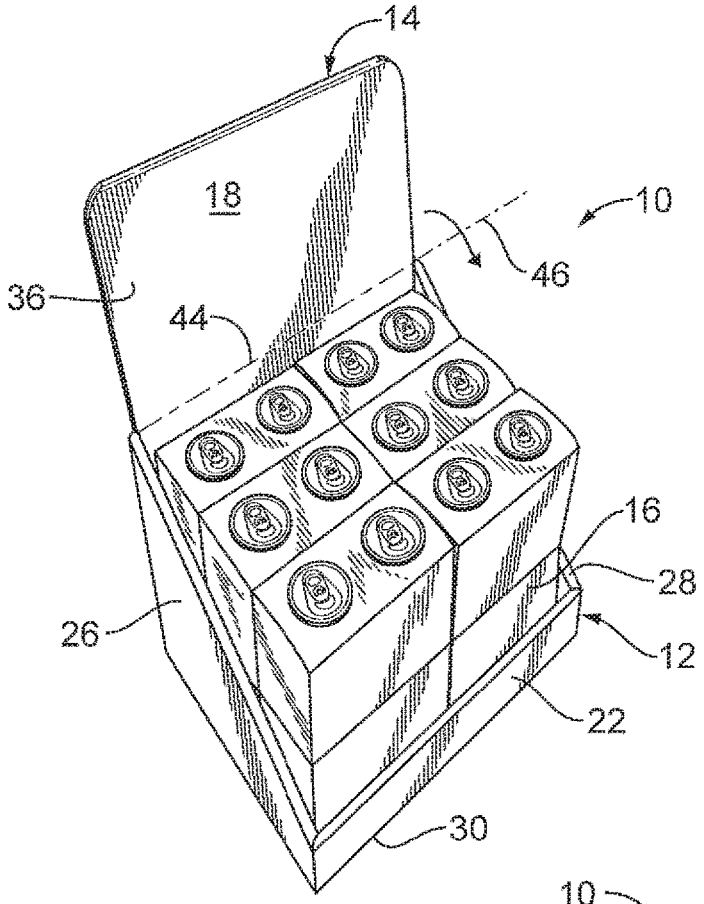
FIG. 1 is a front perspective view of a product display in accordance with this disclosure, showing that the product display includes a flip-up display header integrally coupled to a tray for showing product indicia related to products stored in the tray to a customer at a retail location and with a header board of the display header shown in the extended display position.

Reference will now be made to the drawings wherein like reference numerals identify similar structural features or aspects of the subject disclosure. For purposes of explanation and illustration, and not limitation, an illustrative view of an embodiment of a product display in accordance with the disclosure is shown in FIG. 1 and is designated generally by reference character 100. Other embodiments and/or aspects of this disclosure are shown in FIGS. 2-5.

Figure 2:
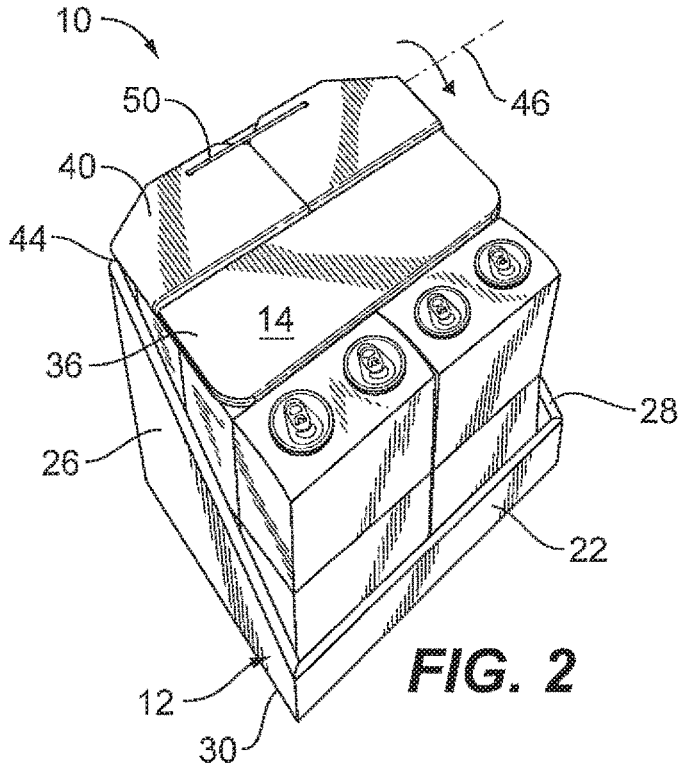
FIG. 2 is similar to the view in FIG. 1 showing the header board of the display header integrally coupled to the tray in a retracted shipping position.
Figure 3:
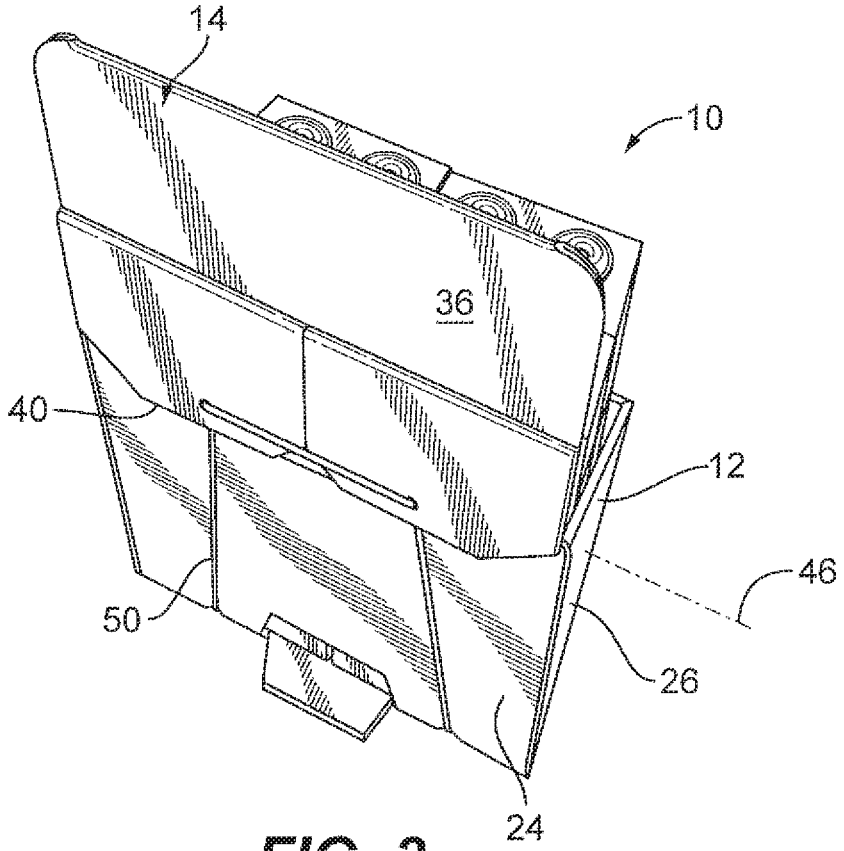
FIG. 3 is a rear perspective view of the product display showing the display header integrally coupled to the tray in the extended display position.
Figure 4:
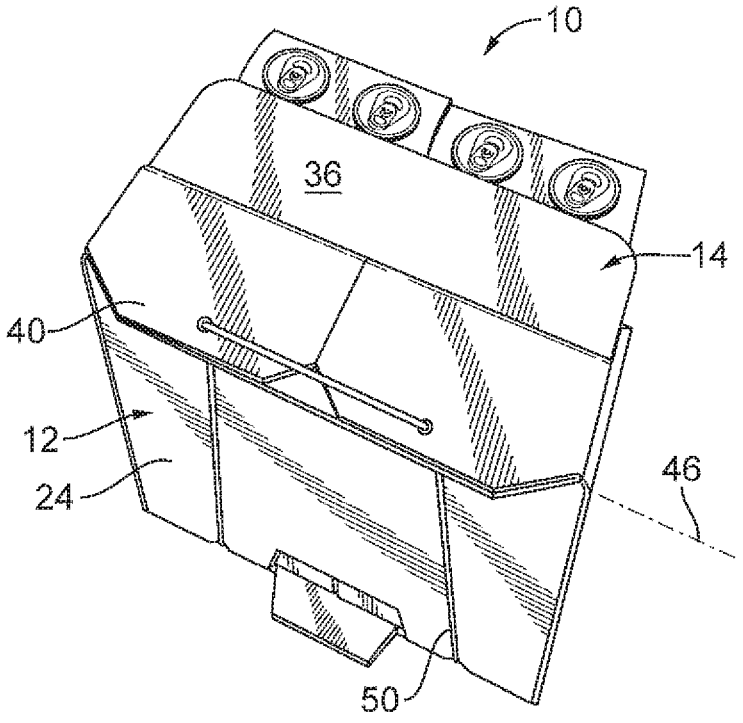
FIG. 4 is similar to the view in FIG. 3 showing the header board of the display header integrally coupled to the tray in the retracted shipping position.

Referring to FIGS. 1-4, a product display 10 in accordance with the present disclosure is shown having an example product disposed therein. Product display 10 can include a product support structure, such as tray 12, and a flip-up display header 14 movably and integrally coupled to tray 12. Display header 14 can be automatically movable with respect to tray 12 from a retracted shipping position as shown in FIGS. 2 and 4 to an extended display position as shown in FIGS. 1 and 3. Tray 12 can be configured to support one or more products in a product-storage region 16 for display in a retail location. Display header 14 can include a product indicia display area 18 on a front side of display header 14 for displaying product indicia related products stored in tray 12 when display header 14 can be located in the extended display position as shown in FIG. 1. Product display 10 can be sized to fit on a shelf or a counter-top, for example at the retail location.

Tray 12 can include a front wall 22, a back wall 24 spaced apart from and generally parallel to front wall 22, a left side wall 26 and a right side wall 28 spaced apart from and generally parallel to left side wall 26. Tray 12 also can include a floor 30 that extends between the bottom ends of walls 22, 24, 26 and 28. Walls 22, 24, 26 and 28 and floor 30 define product-storage region 16.

Display header 14 can include a header board 36 and a stem 40 rigidly coupled to the bottom end of header board 36. The bottom end of header board 36 and a top end of stem 40 are movably coupled to a top end of back wall 24 of tray 12. The bottom end of header board 36 can be integrally coupled to the top end of back wall 24 of tray 12 along a fold line 44 that forms a pivotable hinge having a pivot axis 46 that extends along fold line 44. Header board 36 and stem 40 of display header 14 are movably coupled to the top end of back wall 24 of tray 12 for conjoint pivotal movement about pivot axis 46.

An actuator, such as elastic member 50, resiliently and movably couples stem 40 of display header 14 to a bottom end of back wall 24 of tray 12. Elastic member 50 may comprise an elastic cord having barbs attached to opposing ends thereof for securing elastic member 50 to tray 12. When display header 14 can be in the retracted shipping position as shown in FIGS. 2 and 4, elastic member 50 resiliently biases header board 36 and stem 40 of display header 14 to pivot about fold line 44 and pivot axis 46 from the retracted shipping position as shown in FIGS. 2 and 4 to the upright extended display position as shown in FIGS. 1 and 3. When header board 36 and stem 40 of display header 14 are in the extended display position, header board 36 and stem 40 are generally vertical and generally coplanar with back wall 24 of tray 12. Stem 40 of the display header 14 extends downwardly below fold line 44 and pivot axis 46 and can be located generally adjacent to an outer surface of back wall 24 of tray 12. The biasing force applied to stem 40 of display header 14 by elastic member 50 automatically conjointly pivots header board 36 and stem 40 of display header 14 about pivot axis 46 to the upright extended display position. Header board 36 and stem 40 of display header 14 can be selectively moved from the extended display position as shown in FIGS. 1 and 3 to the retracted shipping position as shown in FIGS. 2 and 4 by manually pivoting header board 36 and stem 40 along fold line 44 and about pivot axis 46 to the retracted shipping position. When header board 36 and stem 40 of display header 14 are in the retracted shipping position, header board 36 and stem 40 are generally horizontal and parallel to floor 30 of tray 12 and stem 40 projects horizontally outwardly from fold line 44 and pivot axis 46 and from the rear surface of back wall 24 of tray 12, while header board 36 projects outwardly in the opposite direction from fold line 44 and pivot axis 46 and from front surface of back wall 24 of tray 12.

Display header 14 may be restrained from pivotal movement from the retracted shipping position to the extended display position such as by enclosing product display 10, with header board 36 and stem 40 in the retracted shipping position, in an external casing, such as a shipping container or packaging. When the external casing is removed from product display 10, header board 36 and stem 40 of display header 14 automatically self-deploy and flip up from the retracted shipping position as shown in FIGS. 2 and 4 to the extended display position as shown in FIGS. 1 and 3. The height of product display 10 when display header 14 is in the retracted shipping position can be shorter than the height of product display 10 when display header 14 is in the extended display position by approximately the height of header board 36 between the bottom end and a top end of header board 36.

Figure 5:
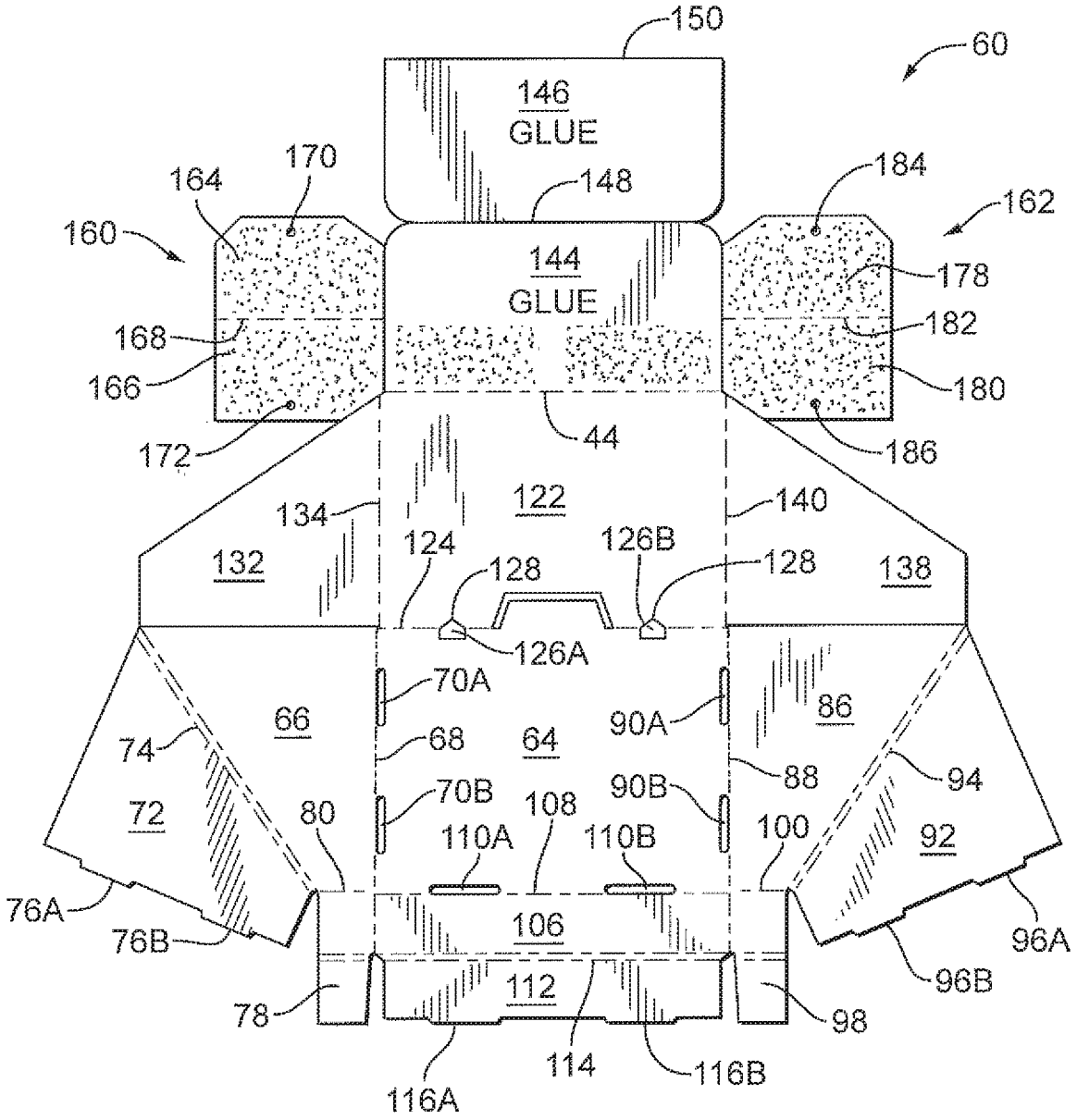
FIG. 5 is a top plan view of one embodiment of a blank in accordance with the present disclosure used to form the tray and display header of the product display of FIG. 1.

One embodiment of a blank 60 in accordance with the present disclosure used to form tray 12 and display header 14 is shown in FIG. 5. As shown and described herein, when making a reference to a blank of material, solid lines denote a cut line where adjacent portions of material are severed from one another and dashed lines denote a fold line where portions of material are adapted to be folded relative to one another. In some examples, fold lines are scored or perforated. It is within the scope of the present disclosure to make blanks from a variety of materials including corrugated paperboard, folding carton, solid fiber, plastic sheeting, plastic corrugated, combinations thereof, or any other suitable material.

Blank 60 can be generally planar and can include an inside surface and an outside surface. Blank 60 can include a tray blank portion for forming tray 12 and a display header portion for forming display header 14. The tray blank portion of blank 60 that forms tray 12 can include a generally rectangular floor panel 64. A left side wall panel 66 can be coupled to floor panel 64 along a fold line 68. Floor panel 64 can include spaced apart elongate slots 70A and 70B that extend along and adjacent to fold line 68. A left flap 72 can be coupled to left side wall panel 66 along a fold line 74. Left flap 72 can include an outer free edge having spaced apart outwardly extending locking tabs 76A and 76B. A front flap 78 can be coupled to a front edge of left side wall panel 66 along a fold line 80. Fold line 80 can be generally perpendicular to fold line 68. Fold line 74 may be disposed at an acute angle to fold line 68 as desired, such as at an angle of 30 degrees or 45 degrees.

A right side wall panel 86 can be coupled to floor panel 64 along a fold line 88. Fold line 88 can be generally parallel to fold line 68. Floor panel 64 can include spaced apart elongate slots 90A and 90B that extend along and adjacent to fold line 88. A right flap 92 can be coupled to right side wall panel 86 along one or more fold lines 94. Right flap 92 can include an outer free edge having spaced apart outwardly extending locking tabs 96A and 96B. A front flap 98 can be coupled to a front edge of right side wall panel 86 along a fold line 100. Fold line 100 can be generally perpendicular to fold line 88 and can be generally colinear with fold line 80. Fold lines 94 may be disposed at an acute angle to fold line 88 as desired, such as at an angle of 30 degrees or 45 degrees.

A generally rectangular front wall panel 106 can be coupled to a front end of floor panel 64 along a fold line 108. Fold line 108 can be generally parallel to and colinear with fold lines 80 and 100. Floor panel 64 can include spaced apart elongate slots 110A and 110B that extend along and adjacent to fold line 108. A generally rectangular front flap 112 can be coupled to an outer end of front wall panel 106 by one or more fold lines 114. Fold lines 114 are spaced apart from and generally parallel to fold line 108. Front flap 112 can include an outer free edge having spaced apart outwardly extending locking tabs 116A and 116B.

A generally rectangular rear wall panel 122 can be coupled at a bottom end thereof to a rear end of floor panel 64 along a fold line 124. Fold line 124 can be generally perpendicular to fold lines 68 and 88, and generally parallel to fold line 108. Rear wall panel 122 can include spaced apart apertures 126A and 126B located adjacent fold line 124 at the bottom end of rear wall panel 122. Each aperture 126A-B can include a notch 128. Each notch 128 of apertures 126A-B can be adapted to receive and retain a respective end of one or more elastic members 50. A rear flap 132 can be coupled to a left edge of rear wall panel 122 along a fold line 134. Fold line 134 can be generally perpendicular to fold line 124 and parallel to the fold line 68. A rear flap 138 can be coupled to a right edge of rear panel 122 along a fold line 140. Fold line 140 can be generally perpendicular to fold line 124 and can be spaced apart from and generally parallel to fold line 134.

The display header blank portion that forms display header 14 can include a generally rectangular back header panel 144 having a bottom edge that can be integrally coupled to the top edge of rear wall panel 122 along fold line 44. A generally rectangular front header panel 146 can be coupled to a top end of back header panel 144 along a fold line 148. Fold line 148 can be generally parallel to and spaced apart from fold line 44. Front header panel 146 can include a generally linear free edge 150 that can be spaced apart from and generally parallel to fold line 148.

The display header portion of blank 60 can include a left connector panel 160 and a right connector panel 162. Left connector panel 160 can include a top panel 164 having a bottom end connected to a top end of a bottom panel 166 along a fold line 168. A top end of top panel 164 can include an aperture 170. A bottom end of bottom panel 166 can include an aperture 172. Bottom panel 166 may be coupled to or separated from back header panel 144.

Right connector panel 162 can include a top panel 178 having a bottom end coupled to a top end of a bottom panel 180 along a fold line 182. A top end of top panel 178 can include an aperture 184. A bottom end of bottom panel 180 can include an aperture 186. Apertures 170, 172, 184, and 186 are adapted to receive elastic member 50.

One illustrative process for forming tray 12 from blank 60 can include folding rear wall panel 122 along fold line 124 to a generally upright position generally perpendicular to horizontal floor panel 64. Rear flap 132 can be folded inwardly along fold line 134 and rear flap 138 can be folded inwardly along fold line 140 such that bottom edges of the rear flap 132 and rear flap 138 extend respectively along fold lines 68 and 88.

Left side wall panel 66 can be folded upwardly along fold line 68 to a generally vertical position generally perpendicular to floor panel 64. Right side wall panel 86 can be folded upwardly along fold line 88 to a generally vertical position generally perpendicular to floor panel 64 and parallel to left side wall panel 66. Front flap 78 can be folded inwardly along fold line 80 such that front flap 78 extends generally along fold line 108 at the front end of floor panel 64. Front flap 98 can be folded inwardly along fold line 100 such that front flap 98 extends generally along fold line 108 and can be generally coplanar with front flap 78.

Front wall panel 106 can be folded along fold line 108 to a generally vertical position generally perpendicular to floor panel 64. Front flap 112 can be folded inwardly along fold lines 114 over front flap 78 and front flap 98 and locking tabs 116A and 116B are respectively inserted into slots 110A and 110B in floor panel 64 to thereby lock front flap 112 in place with front flaps 78 and 98 trapped between front wall panel 106 and front flap 112.

Left flap 72 can be folded inwardly along fold lines 74 over rear flap 132 and locking tabs 76A and 76B are respectively inserted into slots 70A and 70B in floor panel 64 to lock left flap 72 in place with rear flap 132 trapped between left side wall panel 66 and left flap 72. Right flap 92 can be folded inwardly along fold lines 94 over rear flap 138 and locking tabs 96A and 96B are respectively inserted into slots 90A and 90B in floor panel 64 to lock right flap 92 in place with rear flap 138 trapped between right side wall panel 86 and right flap 92.

Display header 14 can be formed by folding front header panel 146 inwardly along fold line 148 such that front header panel 146 is adjacent to and overlies back header panel 144. Front header panel 146 may be coupled to back header panel 144 by a connector, such as by an adhesive or glue material located therebetween. Top panel 164 of left connector panel 160 can be folded along fold line 168 to adjacently overlie bottom panel 166 with aperture 170 coaxially aligned with aperture 172. Top panel 164 may be connected to bottom panel 166 with a connector, such as an adhesive or glue material. Top panel 178 of right connector member 162 can be folded along fold line 182 to adjacently overlie bottom panel 180 with aperture 184 coaxially aligned with aperture 186. Top panel 178 may be connected to bottom panel 180 with a connector, such as an adhesive or glue material located therebetween.

The folded-over left connector member 160 can be connected to a rear surface of back header panel 144 with a bottom end of left connector member 160 and aperture 172 located below the bottom end of back header panel 144 and below fold line 44 and pivot axis 46. Folded-over right connector member 162 can be connected to the rear surface of back header panel 144 adjacent to left connector member 160 with the bottom end of right connector member 162 and apertures 184 and 186 located below the bottom end of back header panel 144 and below fold line 44 and pivot axis 46. Left connector member 160 and right connector member 162 may be connected to back header panel 144 with a connector, such as an adhesive or glue material located therebetween. Left connector member 160, right connector member 162, back header panel 144 and front header panel 146 are conjointly pivotal with respect to tray 12 along fold line 44 and pivot axis 46.

One or more elastic members 50 are threaded through apertures 170 and 172 in left connector member 160 and through apertures 184 and 186 in right connector member 162. A first end of each elastic member 50 can be inserted into notch 128 of aperture 126A in rear wall panel 122 of tray 12 and a second end of each elastic member 50 can be inserted into notch 128 of aperture 126B for connection to rear wall panel 122.

The bottom ends of folded-over left connector member 160 and folded-over right connector member 162 that extend downwardly and outwardly beyond fold line 44 and pivot axis 46 comprise stem 40 of display header 14. As shown in FIG. 4, when display header 14 is in the retracted shipping position and generally horizontal and parallel to floor panel 64 of tray 12, stem 40 projects generally horizontally and outwardly from fold line 44 and pivot axis 46 and from the rear side of rear wall panel 122 of tray 12, while back header panel 144 and first header panel 146 that comprise header board 36 project generally horizontally and outwardly in an opposite direction from fold line 44 and pivot axis 46 from the front side of rear wall panel 122 of tray 12. Elastic member 50 applies a resilient biasing force to stem 40 that resiliently biases display header 14 to pivotally rotate about fold line 44 and pivot axis 46 from the retracted shipping position to the extended display position.

Display header 14 can be manually movable from the extended display position to the retracted shipping position. Display header 14 can be manually pivoted along fold line 44 and pivot axis 46 to the generally horizontal retracted shipping position, as shown in FIGS. 2 and 4, generally parallel to floor panel 64. In order to retain display header 14 in the retracted shipping position, a retention force must be applied to header board 36. The retention force may be applied by a retention member such as a casing that encloses at least a portion of product display 10, for example, a cardboard carton or plastic packaging material.

When the retention force is released from header board 36, elastic member 50 automatically pivots header board 36 and stem 40 of display header 14 along fold line 44 and pivot axis 46 to the generally upright extended display position. Stem 40 of display header 14 engages a rear surface of rear wall panel 122 when display header 14 is in the extended display position to prevent pivotal movement of display header 14 from the horizontal retracted shipping position to an over-rotated position beyond the generally upright extended display position.

When display header 14 is moved to the retracted shipping position, an outer casing can be positioned to surround product display 10 to retain the product in tray 12 and hold display header 14 in the retracted shipping position during transport of product display 10 to a retail location. The user of product display 10 removes the outer casing to expose the products in tray 12 and elastic member 50 automatically moves display header 14 from the retracted shipping position to the extended display position for use in a retail location.

Embodiments as disclosed above can include a product display having a display header attached to a tray for showing product indicia related to products stored in the tray to a customer at a retail location. A product display in accordance with this disclosure can include a display header and a tray. The display header can be integrally coupled to the tray for showing product indicia related to products stored in the tray to a customer at a retail location. In certain embodiments, the display header can include a header board and a stem. The header board and the stem of the display header can be conjointly pivotally movable between a retracted shipping position and an extended display position relative to the tray about a pivot axis. In certain embodiments, an actuator member resiliently can bias the display header to pivot from the retracted shipping position toward the extended display position. Using embodiments, product indicia can be obscured from view when the header board is in the retracted shipping position and can be visible when the header board is in the extended display position.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A product display, comprising:

a product support structure; and a flip-up display header movably and integrally coupled to the product support structure, wherein the display header is automatically movable with respect to the product support structure from a retracted shipping position to an extended display position, wherein the product support structure is a tray, wherein the tray is configured to support one or more products in a product-storage region for display in a retail location, wherein the display header includes a product indicia display area on a front side of display header for displaying product indicia related products stored in the tray when the display header is located in the extended display position, wherein the product display is sized to fit on a shelf or a counter-top, wherein the tray includes a front wall, a back wall spaced apart from and parallel to the front wall, a left side wall, a right side wall spaced apart from and parallel to the left side wall, and a floor that extends between bottom ends of each wall, wherein the walls and floor define the product-storage region, wherein the display header includes a header board and a stem rigidly coupled to a bottom end of the header board, wherein the bottom end of the header board and a top end of the stem are movably coupled to a top end of the back wall of tray, wherein the bottom end of header board is integrally coupled to the top end of the back wall of tray along a fold line that forms a pivotable hinge having a pivot axis that extends along the fold line such that the header board and the stem of the display header are movably coupled to the top end of the back wall of tray for conjoint pivotal movement about the pivot axis, further comprising an actuator resiliently and movably coupling the stein of the display header to a bottom end of the back wall of the tray, wherein the actuator is an elastic member, wherein the elastic member includes an elastic cord having barbs attached to opposing ends thereof for securing the elastic member to the tray, wherein the biasing force applied to the stem of the display header by the elastic member automatically conjointly pivots the header board and the stem of the display header about the pivot axis to the upright extended display position.

2. The product display of claim 1, wherein when display header is in the retracted shipping position, the elastic member resiliently biases the header board and the stem of the display header to pivot about the fold line and the pivot axis from the retracted shipping position to the upright extended display position.

3. The product display of claim 2, wherein when the header board and the stem of the display header are in the extended display position, the header board and the stem are vertical and coplanar with the back wall of tray, and the stem of the display header extends downwardly below the fold line and the pivot axis and is located adjacent to an outer surface of the back wall of the tray.

4. The product display of claim 3, wherein when the header board and the stem of the display header are in the retracted shipping position, the header board and the stem are horizontal and parallel to the floor of the tray and the stem projects horizontally outwardly from the fold line and the pivot axis and from the back wall of the tray, while the header board projects outwardly in the opposite direction from the fold line and pivot axis and from the back wall of the tray.

5. The product display of claim 4, further comprising an external casing configured to restrain the display header from pivotal movement from the retracted shipping position to the extended display position, wherein when the external casing is removed from the product display, the header board and the stem of the display header automatically self-deploy and flip up from the retracted shipping position to the extended display position.

6. A blank configured to form a product display comprising:

a product support structure; and a flip-up display header movably and integrally coupled to the product support structure, wherein the display header is automatically movable with respect to the product support structure from a retracted shipping position to an extended display position, wherein the blank includes a tray blank portion for forming the product support structure, the tray blank portion including:

a rectangular floor panel;

a left side wall panel coupled to the floor panel along a first fold line;

a left flap coupled to the left side wall panel along a second fold line, the left flap including an outer free edge having spaced apart outwardly extending left locking tabs;

a left front flap coupled to a front edge of the left side wall panel along a third fold line that is perpendicular to the first fold line;

a right side wall panel coupled to the floor panel along a fourth fold line, wherein the fourth fold line is parallel to the first fold line;

a right flap coupled to the right side wall panel along a fifth fold line, the right flap including an outer free edge having spaced apart outwardly extending right locking tabs;

a right front flap coupled to a front edge of the right side wall panel along a sixth fold line that is perpendicular to the fourth fold line and is colinear with the third fold line;

a rectangular front wall panel coupled to a front end of the floor panel along a seventh fold line that is parallel to and colinear with the third fold line and the sixth fold line;

a rectangular front flap coupled to an outer end of the front wall panel by an eighth fold line that is spaced apart from and parallel to the seventh fold line, wherein the front flap includes an outer free edge having spaced apart outwardly extending front locking tabs;

a plurality of left spaced apart elongate slots extending along and adjacent to the first fold line and configured to receive the left locking tabs, a plurality of right spaced apart elongate slots extending along and adjacent to the fourth fold line and configured to receive the right locking tabs, a plurality of front spaced apart elongate slots that extend along and adjacent to the seventh fold line and configured to receive the front locking tabs, a rectangular rear wall panel coupled at a bottom end thereof to a rear end of the floor panel along a ninth fold line that is perpendicular to the first fold line and the fourth fold line, and parallel to the seventh fold line, wherein the rear wall panel includes a plurality of spaced apart apertures located adjacent the ninth fold line at the bottom end of the rear wall panel, each aperture including a notch adapted to receive and retain a respective end of one or more elastic members;

a left rear flap coupled to a left edge of the rear wall panel along a tenth fold line that is perpendicular to the ninth fold line and parallel to the first fold line; and a right rear flap coupled to a right edge of the rear panel along an eleventh fold line that is perpendicular to the ninth fold line and is spaced apart from and parallel to the tenth fold line.

7. The blank of claim 6, wherein the blank includes a display header portion for forming the flip-up display header, the display header portion comprising:

a rectangular back header panel having a bottom edge that is integrally coupled to the top edge of the rear wall panel along a twelfth fold line that is parallel the ninth fold line;

a rectangular front header panel coupled to a top end of the back header panel along a thirteenth fold line that is parallel to and spaced apart from the twelfth fold line, wherein the front header panel includes a linear free edge that is spaced apart from and parallel to the thirteenth fold line;

a left connector panel including a left top panel having a bottom end connected to a top end of a left bottom panel along a fourteenth fold line, wherein a top end of the left top panel including a left top aperture and a bottom end of the left bottom panel including a left bottom aperture;

a right connector panel including a right top panel having a bottom end coupled to a top end of a right bottom panel along a fifteenth fold line, wherein a top end of the right top panel includes a right top aperture and a bottom end of the right bottom panel includes a right bottom aperture, wherein the apertures are configured to receive the one or more elastic members.

8. The blank of claim 7, wherein the second fold line is disposed at an acute angle to the first fold line, and the fifth fold lines is disposed at an acute angle to the fourth fold line.

9. The blank of claim 8, wherein the second and fifth fold lines are double folded lines.

10. The blank of claim 9, wherein blank is made up of corrugated board or plastic board.

* * * * *